United States Patent [19]

Fredd

[11] 4,252,195

[45] Feb. 24, 1981

[54] WELL TEST SYSTEMS AND METHODS

[75] Inventor: John V. Fredd, Dallas, Tex.

[73] Assignee: Otis Engineering Corporation, Dallas, Tex.

[21] Appl. No.: 61,032

[22] Filed: Jul. 26, 1979

[51] Int. Cl.[3] ..... E21B 34/10; E21B 34/14; E21B 43/12; E21B 47/06

[52] U.S. Cl. ..... 166/314; 166/113; 166/133; 166/264; 166/319; 166/332

[58] Field of Search ..... 166/151, 152, 142, 126, 166/127, 128, 185, 188, 131, 133, 264, 319, 321, 314–315, 113

[56] References Cited

U.S. PATENT DOCUMENTS

| | | | |
|---|---|---|---|
| 2,715,441 | 8/1955 | Bouvier | 166/142 X |
| 3,152,639 | 10/1964 | Pearcy | 166/264 |
| 3,356,140 | 12/1967 | Young | 166/128 |
| 3,433,301 | 3/1969 | McEver, Jr. | 166/128 |
| 3,572,434 | 3/1971 | Ecuer | 166/319 X |
| 3,860,066 | 1/1975 | Pearce et al. | 166/324 X |
| 4,050,512 | 9/1977 | Giebeler | 166/128 |
| 4,059,153 | 11/1977 | Nix et al. | 166/264 |
| 4,063,593 | 12/1977 | Jessup | 166/317 |
| 4,064,937 | 12/1977 | Barrington | 166/321 X |
| 4,159,643 | 7/1979 | Watkins | 166/250 X |

*Primary Examiner*—Stephen J. Novosad
*Attorney, Agent, or Firm*—Vinson & Elkins

[57] ABSTRACT

A well packer and depending foot valve are landed in a well. A landing nipple depends from the foot valve. A tubing string sealingly engages the packer and includes a circulating valve. A transducer-valve fitting may be run with the packer foot valve assembly or it may be run at a later time and landed in the landing nipple. The foot valve is operated by an actuator which is positioned above the packer and is exposed to the casing tubing annulus as well as tubing pressure. The circulating valve is also exposed to casing-tubing and tubing pressure. The foot valve is controlled by the differential in pressures as is the circulating valve. A transducer may be landed in the transducer fitting and by selectively opening and closing the foot valve data may be taken from the well during both flow and non-flow conditions. After testing is completed the transducer and transducer fitting may be removed and a plug inserted in their place permitting flow thereafter through the foot valve which acts as a subsurface safety valve.

10 Claims, 2 Drawing Figures

WELL TEST SYSTEMS AND METHODS

Figure 1:
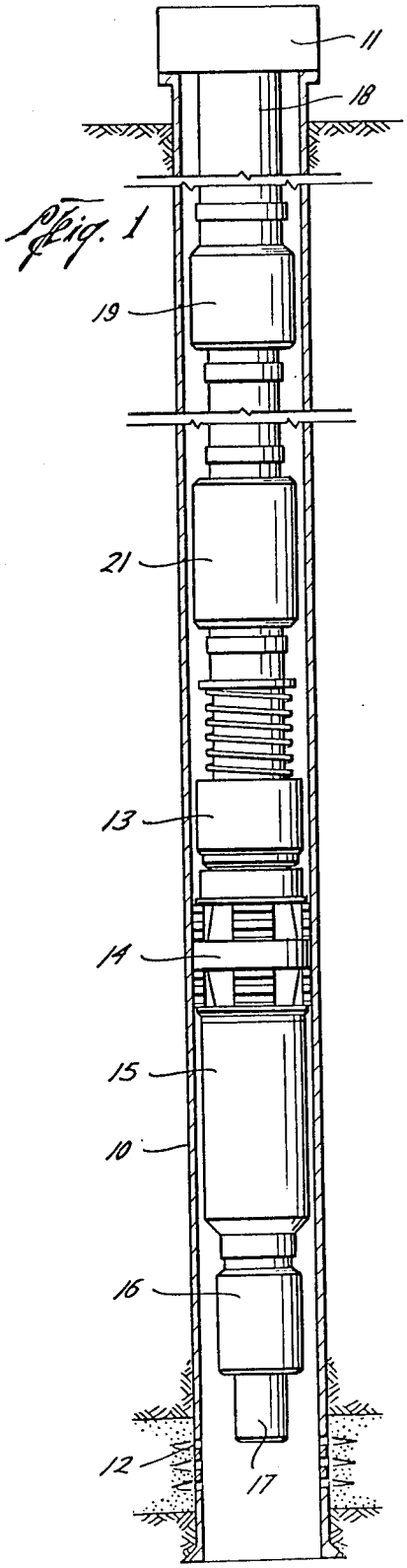

This invention relates to methods and systems for testing petroleum wells.

It is highly desirable when testing a well's potential to be able to flow the well at normal flow rates and to be able to shut in the well and determine the pressure build-up curve after a well has been produced at normal flow rates. In the Kingelin U.S. Pat. Nos. 4,051,897 and 4,134,452 there is shown a system for determining bottom hole pressure, but there is no provision for flowing the well at normal flow rates.

After a well has been drilled it is known to run either a drill stem test system or a tubing test system to obtain build-up curves and flow the well at full flow rates. In both instances packers are run on the tool string, testing is completed, and then the entire tool string is withdrawn from the well leaving the well dependent upon the drilling mud therein, blowout preventers at the surface, etc., to maintain control of the well until such time as it is completed. Completion of the well may not occur for many months for many reasons. See U.S. Pat. Nos. 4,059,153, 4,083,401, 4,113,012, and U.S. Pat. No. RE29,471.

It is desirable in conjunction with the testing procedure to provide for shutting in the well adjacent the producing formation and utilizing the well control equipment for both testing of the well and shutting in the well adjacent the formation after testing has been completed. It is further desirable that complete well control be possible by yo-yoing the casing-tubing annulus versus tubing pressure as control of these pressures does not interfere with the blowout preventers at the surface, and does not require electrical power source for operating tools or the like.

An object of this invention is to provide a well test system in which a packer and foot valve are first run and set in the hole and the foot valve controls the flow from the formation.

Another object is to provide a test system as in the preceding object in which the foot valve acts as a subsurface safety valve and closes in response to reduction in casing-tubing annulus pressure.

Another object is to provide a system and method for testing a well in which a packer and foot valve are first landed in the well and an actuator is run in on a tubing string to actuate the foot valve in response to differences between internal and external pressure on the actuator.

Another object is to provide a well test system in which a packer and foot valve are first landed in a well and thereafter tubing is run and the foot valve controlled by difference in pressure between the tubing and the tubing-casing annulus and the foot valve acts as a subsurface safety valve and closes in the event of reduction in casing-tubing annulus pressure and in which bottom hole pressure sensing devices may be landed below the foot valve and the well alternately flowed and pressure tested under non-flowing conditions while the foot valve is closed.

Another object is to provide a method and system as in the preceding object in which the pressure sensing device may be removed and the bottom of the foot valve closed so that the tubing may be removed and the foot valve left in closed position to thus shut in the well immediately above the formation until such time as it is desired to complete the well.

Another object is to provide a system and method of testing wells in which a packer and foot valve are set in a hole and the tubing through which testing is carried out includes a circulating valve and in which yo-yoing of the casing-tubing annulus pressure relative to tubing pressure can open and close the foot valve and can open the circulating valve.

Another object is to provide a method and system of well testing in which a packer and foot valve are landed in a well and a transducer valve fitting is landed in a landing nipple below the foot valve and the transducer valve fitting is opened and closed by vertical movement of a transducer landed in the fitting.

Another object is to provide a system and method of testing wells in which a packer having a foot valve depending therefrom is set above the producing formation and a tubing carrying an actuator at its lower end is set down on the packer in sealing relationship and the foot valve is controlled by controlling the casing to tubing pressure differential effective on the actuator.

Other objects, features and advantages of the invention will be apparent from the drawings, the specification and the Claims.

Figure 2:
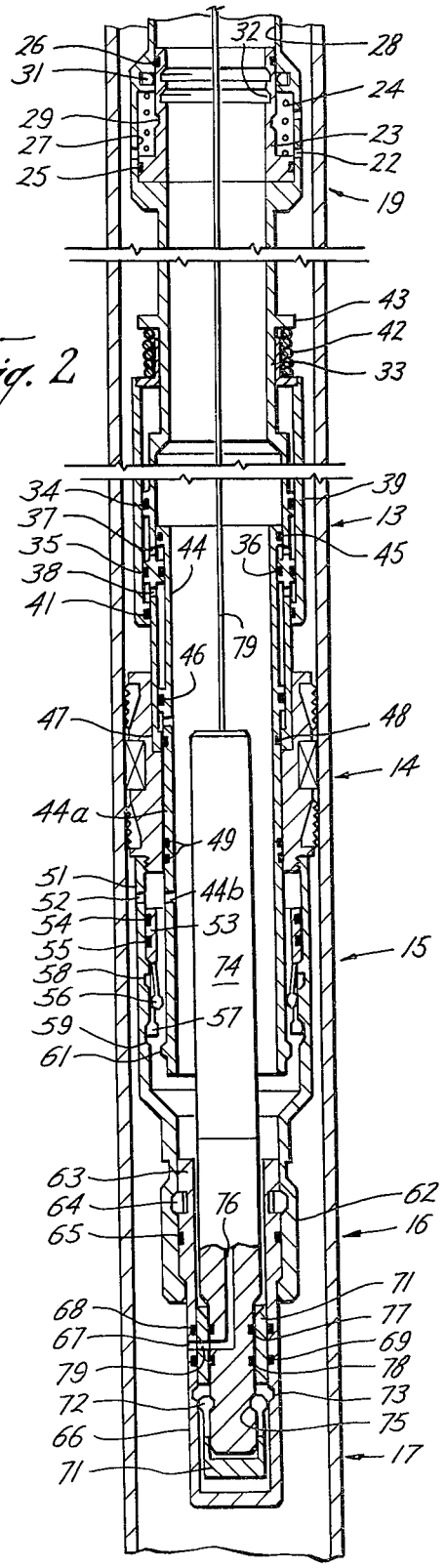

In the drawings wherein an illustrative embodiment of this invention is shown, and wherein like parts are indicated by like reference numerals, FIG. 1 is a schematic illustration of a well installation employing the actuator of this invention; and FIG. 2 shows in schematic cross-section an illustrative embodiment of this invention.

In carrying out the method of this invention, a well is drilled, cased and perforated in the conventional manner. In testing the well a conventional packer is run in and landed in the well as by conventional wireline techniques. It is intended that this packer remain in the well and be utilized to isolate the casing above the packer from the producing formation during normal production of the well.

There is run in with the packer and depending therefrom a foot valve of the sleeve type having a bore through which equipment will pass. While any desired foot valve may be utilized, it is preferred that the foot valve shown in my co-pending United States Application for Patent filed July 12, 1979 for "VALVE", U.S. Patent Office Ser. No. 053,782, be utilized. The disclosure of this application is incorporated herein by reference in its entirety.

It is intended that this foot valve be opened and closed during the testing procedure to selectively provide for flow from the producing formation at full open tubing test rates. During the time the foot valve is closed during the testing procedure, bottom hole pressure and pressure build-up curves can be obtained.

Also run with the packer and depending from the foot valve is a landing nipple which may be of any desired form but is preferably one of the landing nipples shown at page 5324 of the *Composite Catalog of Oil Field Equipment and Services* for 1978 and 1979. The locking mandrels also shown on the same page are preferably used to lock equipment in the landing mandrel. For instance, if it is desired to run the packer with a plug such may be run in place with a plug carried by the locking mandrel. If desired, the packer and foot valve and landing nipple may be run, the packer landed and thereafter a locking mandrel and plug may be run in the conventional manner, as by wireline, to land in the landing nipple and close the bore through the packer. If the well is to be plugged the locking mandrel and plug are removed, as by conventional wireline techniques, before carrying out the pressure test steps.

In the alternative, the locking mandrel may carry a transducer fitting at the time the packer is run with the transducer fitting supported in the landing nipple by the locking mandrel. If the transducer fitting is run with the packer, its lower end is closed. The fitting includes a sleeve valve and the sleeve valve may be run in either open or closed position, but it preferably will be run closed.

While any transducer fitting may be utilized, it is preferred that the transducer fitting and associated probes disclosed in my co-pending application for United States Patent for "VALVE" filed July 12, 1979, and given U.S. Patent Office Ser. No. 056,886, be utilized. The disclosure of this application is incorporated herein in its entirety by reference.

In the event it is decided to run the packer without the transducer fitting or run the packer with a plug associated therewith, the transducer fitting would be run in the well through the tubing after the tubing has been sealingly joined with the packer utilizing conventional running techniques, such as wireline. One advantage of this method is it permits the running of the transducer fitting through the tubing with the foot valve open so that fluid in the well does not inhibit the running and landing of the transducer fitting as would be the case if the well were shut in. The use of the foot valve in the system also makes it relatively easy to pull the transducer fitting as the foot valve may be opened to equalize pressure above and below the foot valve and permit it to be readily pulled from the well.

The test tubing is run in the well carrying at its lower end an actuator for actuating the foot valve. This actuator may be any desired type which extends through the packer, contacts the foot valve and provides for its actuation in response to differential in casing-tubing and tubing pressure, preferably aided by spring force. While any desired actuator might be used, the actuator shown in my co-pending U.S. Application for Patent for "ACTUATOR", filed July 23, 1979, and given U.S. Patent Office Ser. No. 059,666, is preferred. The disclosure of this application is incorporated herein in its entirety by reference. The actuator lands in the packer and sealingly engages therewith to provide fluid-tight integrity of the producing formation and the producing tubing. By controlling the casing-tubing pressure, the actuator will open and close the foot valve at the discretion of the operator to provide for full flow of the formation at normal testing conditions to obtain data about the formation being produced.

Also in the tubing is a circulating valve which preferably is closed and will open in response to increase of tubing pressure to provide for circulation of fluid between the casing-tubing annulus and the tubing. Preferably, this circulating valve is the valve shown in my Application for United States Patent Ser. No. 044,046 filed May 31, 1979. The disclosure of this application is incorporated in its entirety herein by reference.

If desired, a dump valve may also be employed to hold a column of fluid in the tubing during running which is automatically opened when the tubing sets down on the packer. This fluid may be lighter than annulus fluid which would rise in the tubing while being run in the absence of the valve.

After the tubing is in place, the transducer fitting and its associated locking mandrel may be run and landed if such is not already in place.

A transducer is now run into the well, as by conventional wireline techniques, and landed in the transducer fitting. As shown in my above identified co-pending application for a transducer fitting, this transducer automatically opens and closes the slide valve in the transducer fitting with vertical movement of the transducer. In other words, when the transducer is landed and moved downwardly, it preferably moves the transducer fitting slide valve to open position and when the transducer is pulled it automatically closes the slide valve of the transducer fitting. In accordance with said above disclosure, the transducer may collect samples of fluid, may record pressures at the location of the transducer, or may transmit pressure readings back to the surface through an electric line where they may be recorded or transmitted to a suitable computer, as desired.

The operator may now selectively open and close the foot valve by controlling the casing-tubing annulus to tubing pressure differential to flow the well selectively and to shut in the well and obtain bottom hole pressure build-up curves, temperatures and any other information which may be gained by suitable instrumentation in the transducer.

After testing is completed, the transducer is removed, as by wireline. This preferably automatically closes the transducer fitting. Thereafter, a suitable pulling tool may be utilized to remove the locking mandrel and transducer fitting. Preferably, the locking mandrel is run back in the hole with a plug on the bottom of the mandrel to in this way plug the bottom of the packer.

The actuator would now be operated to make sure that the foot valve is closed and the tubing string and actuator removed from the hole. Preferably, the foot valve actuator is of a type which automatically mechanically closes the foot valve as shown in the above identified application. As the actuator is pulled the actuating flange engages the latching collet if the valve is not closed and moves the foot valve to closed position. This leaves the well shut in at the bottom, but ready for production at any time it is desired to run a producing tubing string and land same in the packer.

When the well is to be produced the tubing may carry an actuator to open the foot valve and permit production through the foot valve. This is of particular advantage in multiple completions where an additional formation below that shown is to be produced.

Referring now to the drawings and particularly to FIG. 1, there is shown a well having a casing 10 and standard surface equipment 11 at the top of the well. The casing and well are shown to be perforated at 12 into the formation to be tested.

Within the well there is an assembly made up of a packer 14, foot valve 15, landing nipple 16, and transducer fitting 17, which are preferably run into the well and landed in place in a preliminary operation, as by conventional wireline techniques.

The test or production pipe which may be a drill stem but is preferably a production tubing 18 is shown to have a circulating valve 19, a cushion valve 21, and an actuator 13 with a tailpipe or actuator mandrel of the actuator unit in sealing engagement with the packer 14. During the running of the tubing 18, the cushion valve may be utilized to support a column of fluid in the tubing which is released by opening of the cushion valve when the string engages the packer 14. The circulating valve 19 may be utilized as needed. It is normally closed, but conditions may arise when it is desirable or imperative to provide for circulating between the casing-tubing annulus and the tubing. The circulating valve 19 may be quickly and readily opened for such circulation.

The packer 14 packs off the producing formation and the foot sleeve valve 15 controls the flow through the foot sleeve and into the tubing. The landing nipple and transducer fitting provide for landing of a transducer, such as a pressure sensing device, within the fitting to sense the pressure in the casing and below the packer. With this assembly, static pressure in the formation below the packer as well as build-up pressure can be recorded or transmitted to the surface through a suitable electric line and flow can be provided through the foot sleeve valve to test the flow characteristics of the well.

Reference is now made to FIG. 2 wherein the several components of the system shown in FIG. 1 are shown in more detail with the exception of the cushion valve 21, which may be any type of valve which is operated by telescoping of the lower tubing section to latch it in open position.

The circulating valve body is ported at 22 and a sleeve valve member 23 is reciprocal within the body. A resilient spring 24 urges the sleeve valve member 23 to the down valve closing position. Suitable seals 25 below the port 22 and 26 above the port 22 prevent flow through the port 22 when the valve member is in the closed position. It will be noted that the bore 27 in which seal 25 reciprocates and the bore 28 in which the seal 26 reciprocates are of different diameters, providing a pressure responsive area internally of the valve responsive to tubing pressure. Through port 22 the same area is responsive to casing-tubing annulus pressure. Thus, by raising the tubing pressure to a value exceeding the force of casing presssure and the force of the spring 24, the valve member 23 may be moved upwardly to open port 22 and allow for circulation between the casing-tubing annulus and the tubing. The valve member is provided with a groove 29 and a split ring 31 is carried in the body 21. The split ring in the position shown is held in the expanded or stress condition so that when the valve member moves upwardly to bring the groove 29 in register with the ring the ring will snap into the groove 29 and reside partially within the groove in valve member 23 to latch the valve member in the raised or open position.

With the valve member held in upper position, the port 22 is open and circulation may be provided in either direction between the casing-tubing annulus and the tubing. If it is desired to thereafter close the circulating valve a suitable tool is run into the well, as by wireline, and engages the groove 32 within the bore of the valve member 23. Jarring down on this tool will force the ring 31 to expand and permit the valve member to return to closed position.

The body 33 of the actuator 13 carries the external seals 34 and 35 and the internal seal 36. Ports 37 and 38 are provided in the body. The body is surrounded by an outer sleeve 39 which carries the seal 41. This outer sleeve 39 is urged downwardly by spring 42 which is in compression between the sleeve and a stop 43 on the body. An inner sleeve 44 carries seals 45 and 46. The body sleeves, seals and ports just described provide constant volume chambers above and below the two seals 35 and 36. These chambers are filled with hydraulic fluid and movement of the outer sleeve 39 in response to casing-tubing annulus pressure will positively move the sleeve 44 downwardly against the force of spring 42 and the force of tubing pressure acting against the sleeve 44. When the casing pressure is reduced, the tubing pressure and the force of the spring 42 will move the sleeve 44 upwardly in the body.

The inner sleeve 44 extends downwardly and provides an actuator member **44*a* for shifting the foot valve between open and closed positions. As shown at 47 the lower end of the actuator is supported on the packer 14 and seal 48 provides a seal between the tubing and the actuator member 44*a*. In like manner a plurality of seals 49 carried by the actuator member 44*a*** seal between the actuator member and the packer body as the member reciprocates to provide fluid integrity between the packer and the actuator member.

The body 51 of the foot valve is dependent from the packer 14. A port 52 is provided in the side wall of the body and flow through this port is controlled by the slide valve member 53 having spaced seals 54 and 55 which seal with the body and control flow through the port. The valve member 53 has at its lower end spaced collets 56 and 57 which cooperate respectively with grooves 58 and 59.

The lower end of the actuator **44*a* has an outwardly extending circumferential flange 61 which cooperates with the two collets 56 and 57 to shift the valve member between open and closed positions. With the valve in closed position and the actuator in its up position, the actuator will be above both collets. The collets will reside in their respective groove 58 and 59 when in the unstressed position. Thus, with the valve member in the up position, the collet 56 lies within groove 58 and collet 57 is held inwardly under stress by the land between the two grooves 58 and 59. Thus, as the actuator 44*a* is moved downwardly the flange 61 engages collet 57 and moves the valve member downwardly, withdrawing the collet 56 from groove 58. As the collet 57 passes over groove 59 it moves outwardly and releases the actuator with the valve held in open position. Conversely, upward movement causes the actuator flange 61 to engage the collet 56** and move the valve back to the up position.

It will be noted that the actuator has a port **44*b* therethrough to permit fluid to flow through the port 52 and the port 44*b*** upwardly through the actuator to the surface.

Depending from the foot valve is a conventional landing nipple 62 with a locking mandrel 63 therein. This structure is conventional and dogs 64 releasably latch the locking mandrel in place and a suitable seal 65 seals between the landing nipple and the locking mandrel.

Depending from the locking mandrel is the transducer fitting 17. This fitting includes the body 66 having a port 67 therein with spaced seals 68 and 69 on opposite sides of the port. A valve member 71 of the sleeve valve type is reciprocal within the body 66. The valve member includes a collet 72 which cooperates with the groove 73 within the body 66 to latch the valve in closed position.

A transducer 74 is run into the well and landed within the valve 71. Downward movement of the transducer after landing shifts the valve downwardly with the collet 72 held within the groove 75 in the transducer so that later upward movement of the transducer automatically returns the valve to closed position.

The transducer has a flowway 76 therein which terminates in the side wall of the transducer between the seals 77 and 78. This flowway 76 matches up with the port 79 through the valve member and the port 67 in the transducer fitting so that flow from the well can pass through the passageway 76 into the transducer 74 where pressure, temperatures and the like are measured and transmitted to the surface through the electric line 79.

The apparatus illustrated in the drawings and just described is used in the manner described hereinabove in carrying out the method of this invention.

The foregoing disclosure and description of the invention are illustrative and explanatory thereof and various changes in the size, shape and materials, as well as in the details of the illustrated construction, and various changes in the method may be made within the scope of the appended claims without departing from the spirit of the invention.

What is claimed is:

1. A well test system comprising,
a well packer having a bore therethrough,
a sleeve-type foot valve having a bore therethrough depending from said packer,
a tubular actuator having a bore therethrough engaging the top of said packer,
said actuator having an actuator member extending through said packer for opening and closing said foot valve, and
said actuator including a pressure responsive member exposed to pressure within and without said actuator moving said actuator member in response to differential between pressure internal and external of said valve actuator.

2. A well test system comprising,
a well packer having a bore therethrough,
a sleeve-type foot valve having a bore therethrough depending from said packer,
a tubular actuator having a bore therethrough engaging the top of said packer,
said actuator having an actuator member extending through said packer for opening and closing said foot valve,
resilient means urging said actuator member toward foot valve closing position, and
said actuator including a pressure responsive member exposed to pressure within and without said actuator moving said actuator member against said resilient means in response to high exterior pressure relative to internal pressure to open said foot valve.

3. The system of claim 2 including,
a tubular circulating valve having a bore therethrough positioned above said packer,
resilient means urging said circulating valve toward closed position, and
pressure responsive means exposed to pressure within and without said circulating valve and moving said circulating valve to open position in response to high internal pressure relative to external pressure.

4. The system of claim 2 or 3 including,
a transducer-valve fitting depending from said foot valve and movable between open and closed position by vertical movement of a transducer landed in said transducer-valve fitting,
said transducer-valve fitting dimensioned to pass through the bore through the other elements of said well test system.

5. The system of claim 2 wherein said resilient means closes said foot valve upon a reduction in casing pressure and said foot valve may also be closed by lifting said actuator.

6. The method of operating a cased well comprising,
assembling a sleeve-type foot valve below a packer and a transducer-valve fitting below the foot valve,
running said assembly in the well and setting the packer above the producing formation,
sealingly joining a tubing carrying an actuator at its lower end to the packer,
operating the foot valve by controlling the casing to tubing pressure differential effective on the actuator,
while the foot valve is closed running in the tubing and landing in the transducer-valve fitting a transducer,
opening the transducer-valve fitting to expose the transducer to formation pressure, and
selectively opening and closing the foot valve to selectively flow the well.

7. The method of claim 6 including,
removing the transducer and transducer-valve fitting and thereafter plugging the remainder of the assembly below the foot valve and flowing the well using the foot valve as a safety valve.

8. The method of operating a cased well comprising,
setting a packer having a sleeve-type foot valve depending therefrom above the producing formation,
sealingly joining a tubing carrying an actuator at its lower end to the packer, and
operating the foot valve by controlling the casing to tubing pressure differential effective on the actuator.

9. The method of claim 8 including,
providing a landing nipple below the foot valve,
landing a transducer-valve fitting in the landing nipple,
landing a transducer in said transducer-valve fitting,
selectively flowing the well and obtaining bottom hole pressure with said transducer,
pulling said transducer and transducer fitting and plugging said landing nipple and producing the well through said foot valve.

10. The method of operating a cased well having a tubing in the well with a packer set between the casing and tubing, a foot valve below the packer, an actuator above the valve for shifting the foot valve between open and closed position, and a circulating valve comprising:
increasing the casing pressure relative to the tubing pressure to shift the foot valve to open position and flow the well through the foot valve,
reducing the casing pressure to close the foot valve and prevent flow from the formation being produced, and
increasing the tubing pressure relative to casing pressure after the foot valve has closed to open the circulating valve and circulating fluid between the casing-tubing annulus and tubing.

* * * * *